US007216373B2

(12) United States Patent
Huang

(10) Patent No.: US 7,216,373 B2
(45) Date of Patent: May 15, 2007

(54) TOILET TANK VALVE SEAT STRUCTURE

(76) Inventor: So-Mel Huang, No. 289, Peng Yi Road, Taipping City, Taichung (TW)

( * ) Notice: Subject to any disclaimer, the term of this patent is extended or adjusted under 35 U.S.C. 154(b) by 357 days.

(21) Appl. No.: 10/873,154

(22) Filed: Jun. 23, 2004

(65) Prior Publication Data

US 2005/0283896 A1 Dec. 29, 2005

(51) Int. Cl.
*E03D 1/35* (2006.01)

(52) U.S. Cl. ..... 4/393; 4/404

(58) Field of Classification Search ..... 4/324–326, 4/353, 378, 392–395, 40, 3, 404, 4, 15, 686
See application file for complete search history.

(56) References Cited

U.S. PATENT DOCUMENTS 5,754,986 A * 5/1998 Chien ..... 4/326 X
2003/0213054 A1* 11/2003 Huang ..... 4/395

* cited by examiner

*Primary Examiner*—Robert M. Fetsuga
(74) *Attorney, Agent, or Firm*—Troxell Law Office, PLLC

(57) ABSTRACT

A toilet tank valve seat structure mainly includes a body and an overflow tube located on one side of the body. The overflow tube consists of an inner tube and an outer tube. The inner tube has a gear rack on one side to couple with a hook located on one end of the outer tube so that the outer tube may be moved up and down to adjust the length of the overflow tube. The body has a valve opening covered by a plug. The plug has an anchor notch bordering by two slots on two sides that provide elasticity to make coupling of the anchor notch easier. The structure provides the overflow tube with an adjustable length according to the water level and makes replacement of the plug easier.

7 Claims, 6 Drawing Sheets

TOILET TANK VALVE SEAT STRUCTURE

BACKGROUND OF THE INVENTION

1. Field of the Invention

The invention relates to a toilet tank valve seat structure and particularly to a valve seat that has an overflow tube with an adjustable length and a plug easy to couple.

2. Description of the Prior Art

Referring to FIG. 1, a conventional valve seat 1 of a toilet tank includes a body 10 and an overflow tube 11 located on one side of the body. The overflow tube 11 has an overflow outlet 111 at the top end to discharge excessive water through a valve opening 101 to prevent the water in the tank from spilling outside the tank. The overflow tube 11 has a strut 102 on a lower side to couple with an anchor notch 121 of a stopping cap 12. The stopping cap 12 has a seal pad 122 to cover the upper side of the valve opening 101 and is driven by a chain 13 to move about the strut 102 which serves as a fulcrum to control the water to flush from the tank into the toilet. Such a structure still has problems in practice, notably:

1. The overflow tube 11 has a fixed length and must be cut to a corresponding height according to the water level. If the length of the overflow tube is not proper, or the water level is altered, the overflow tube 11 cannot function as desired, and the valve seat has to be replaced.
2. After the stopping cap 12 has been used for a period of time, the seal pad 122 could be aged and hardened, and the sealing effect is impaired. Hence the seal pad has to be replaced periodically. Due to the strut 102 and the anchor notch 121 are coupled forcefully, removing or coupling of the two could result in breaking of the strut 102 or hurting user's hands.

SUMMARY OF THE INVENTION

In view of the aforesaid disadvantages, the primary object of the present invention is to provide an improved toilet tank valve seat structure to overcome the problems of the overflow tube whose length cannot be adjusted to suit change of water level and the plug which is not easy to replace. The invention provides an overflow tube which has an alterable length to suit different water levels and an elastic anchor notch to make replacing of the plug easier.

The valve seat according to the invention mainly includes an overflow tube on one side of a body. The overflow tube has an inner tube and an outer tube. The inner tube has a gear rack on one side to couple with a hook on one end of the outer tube so that the outer tube may be moved up and down to adjust the length of the overflow tube. The body has a valve opening to couple with a plug on the upper side. The plug has an anchor notch with two slots formed on two sides so that the anchor notch has a greater elasticity to facilitate coupling. The structure allows the length of the overflow tube to be adjusted to suit water level and makes coupling and replacing of the plug easier.

The foregoing, as well as additional objects, features and advantages of the invention will be more readily apparent from the following detailed description, which proceeds with reference to the accompanying drawings.

DESCRIPTION OF THE PREFERRED EMBODIMENT

Figure 1:
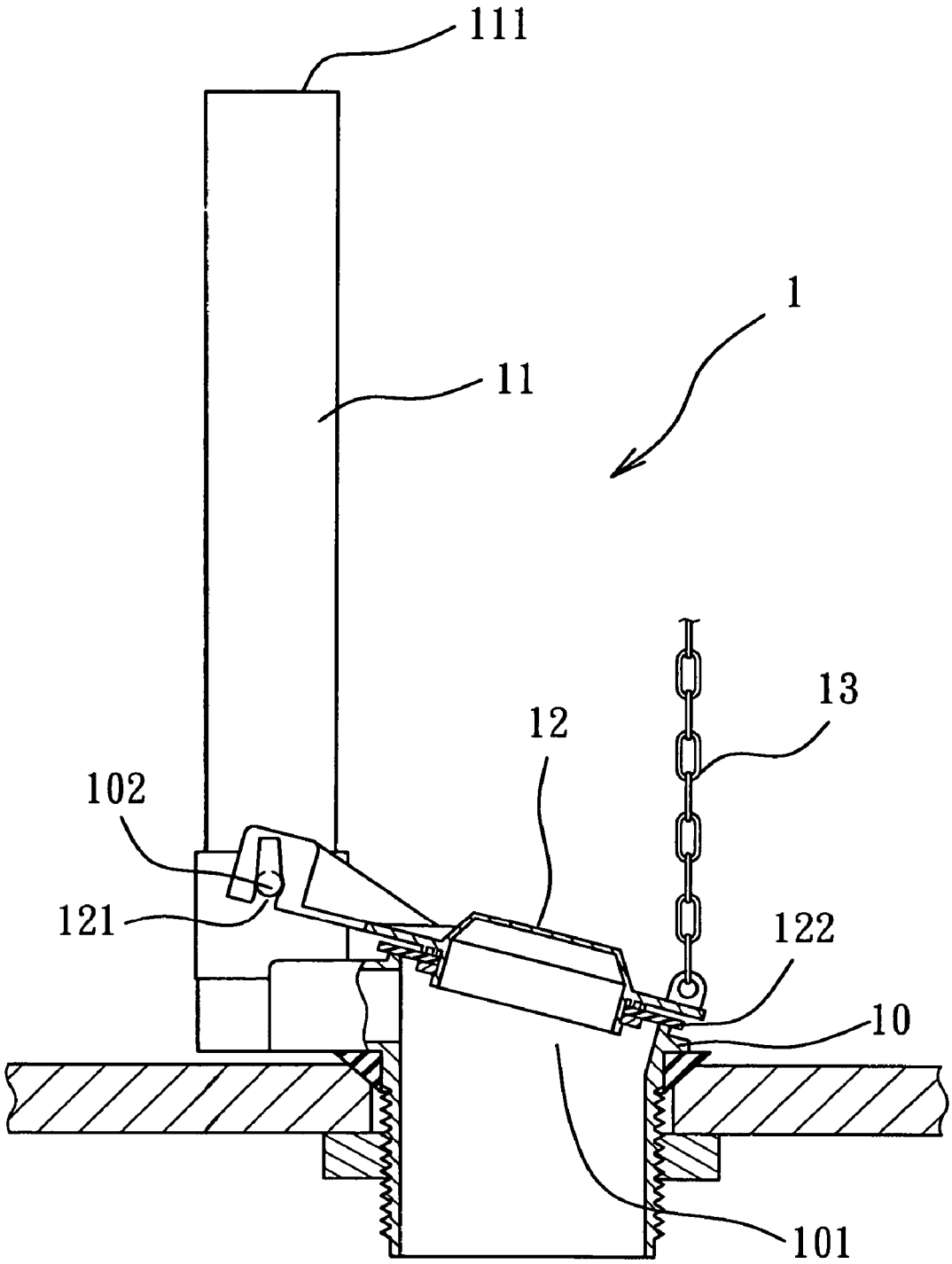
FIG. 1 PRIOR ART
FIG. 1 is a fragmentary sectional view of a conventional valve seat.
Figure 2:
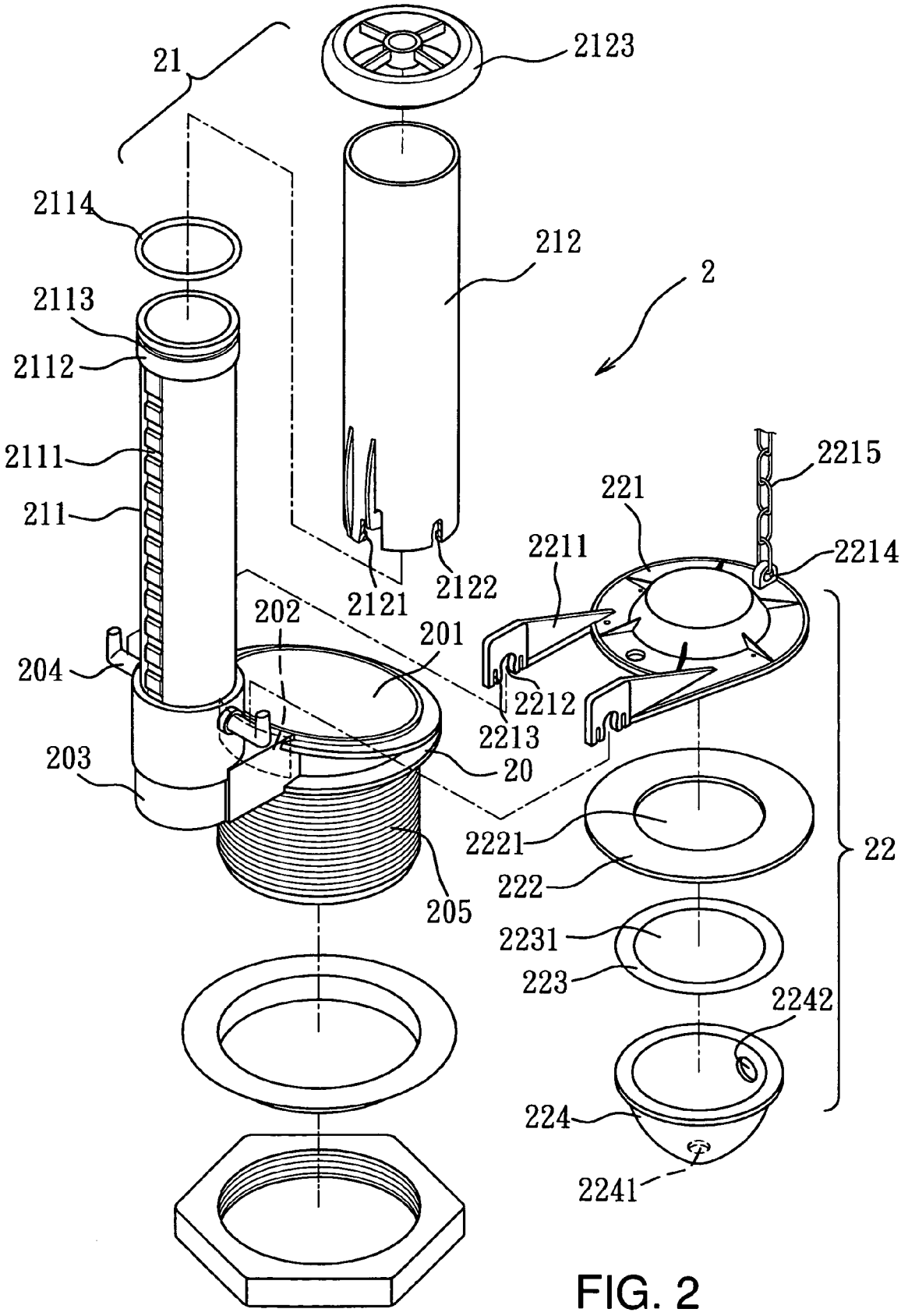
FIG. 2 is an exploded view of the invention.
Figure 3:
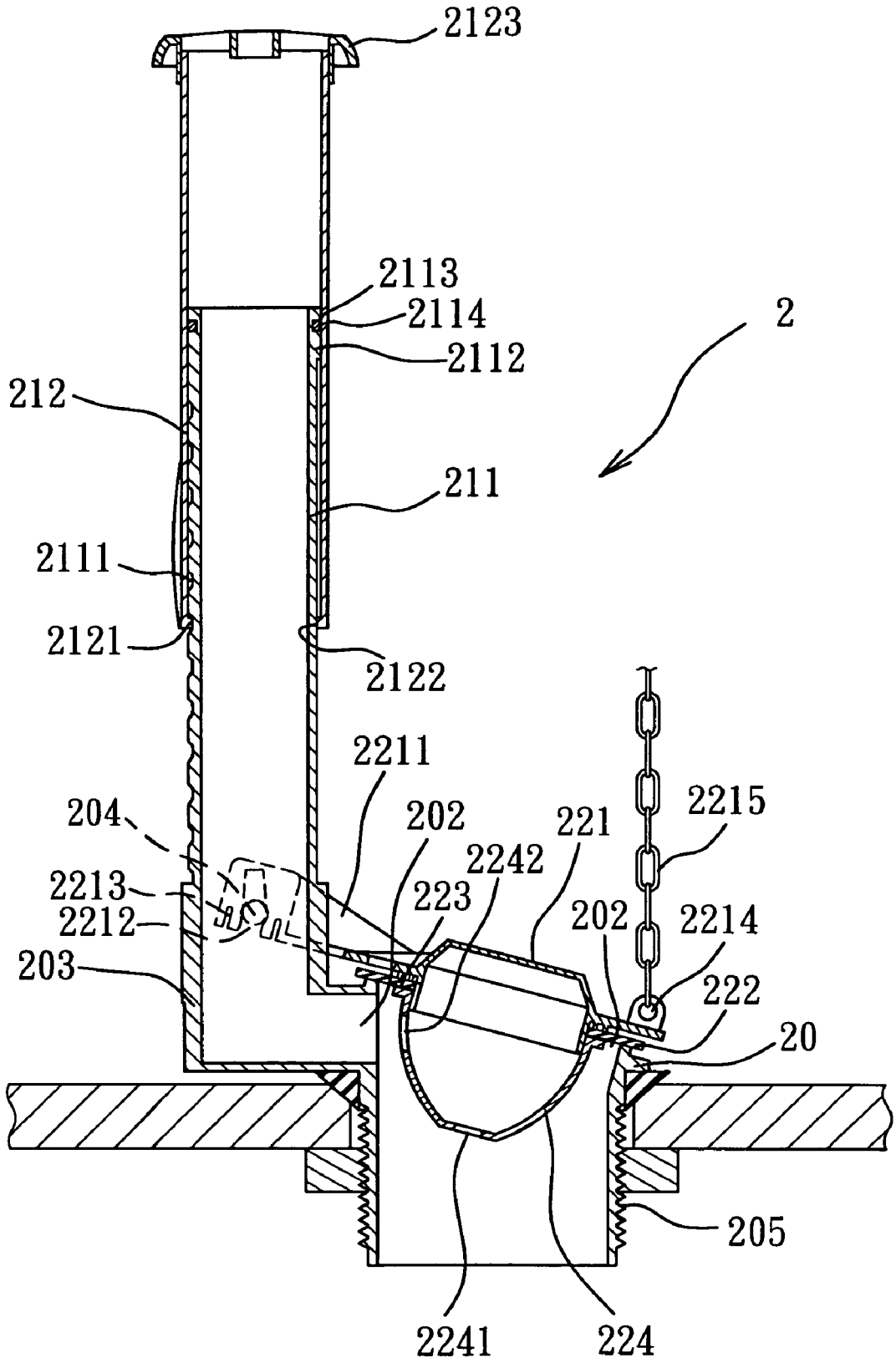
FIG. 3 is a sectional view of the invention.

Referring to FIGS. 2 and 3, the valve seat 2 according to the invention mainly includes a body 20, an overflow tube 21 and a plug 22.

The body 20 has a valve opening 201 which has one side communicating with a water discharge outlet 202 to form a jutting dock 203. The jutting dock 203 has two L-shape struts 204 extending from two sides. The body 20 has an external screw thread section 205 on the outer side.

The overflow tube 21 includes an inner tube 211 and an outer tube 212.

The inner tube 211 is hollow and has one end mounted onto the jutting dock 203, a gear rack 2111 located on one side, and a bulged rim 2112 on the top end. The bulged rim 2112 has an annular groove 2113 to couple with a seal ring 2114.

The outer tube 212 is hollow to couple with the inner tube from outside. It has a hook 2121 and a bulged rim 2122 on the inner side of a lower end. The hook 2121 is engageable with the gear rack 2111 of the inner tube 211. The bulged rim 2122 presses the outer side of the inner tube 211 and is confined below the bulged rim 2112 of the inner tube 211 so that the outer tube 212 may slide up and down without breaking off. The top end of the outer tube 212 is coupled with a water intake head 2123.

The plug 22 includes a cap 221, a seal pad 222, a washer 223 and a plug dome 224.

The cap 221 is a circular tray slightly larger than the valve opening 201. The seal pad 222, washer 223 and plug dome 224 are coupled on the bottom of the seal cap 221 in this order. It has two arms 2211 on two sides. The distal end of the arms 2211 has an anchor notch 2212 to couple on the strut 204 of the body 20. There are two slots 2213 on two sides of the anchor notch 2212. The cap 221 has an aperture 2214 on another side to couple with a chain 2215.

The seal pad 222 is a pliable blade with an outer diameter slightly larger than the valve opening 201, and has a round opening 2221 in the center to couple with the lower side of the cap 221.

The washer 223 is a hard blade sandwiched between the seal pad 222 and the plug dome 224 to reduce the friction resistant force when the plug dome 224 is turned. The washer 223 has a round opening 2231 in the center.

The plug dome 224 is a hollow semi-spherical member located below the cap 221 and is turnable. It has a water inlet 2241 on the bottom and an air vent 2242 on one side.

Figure 4:
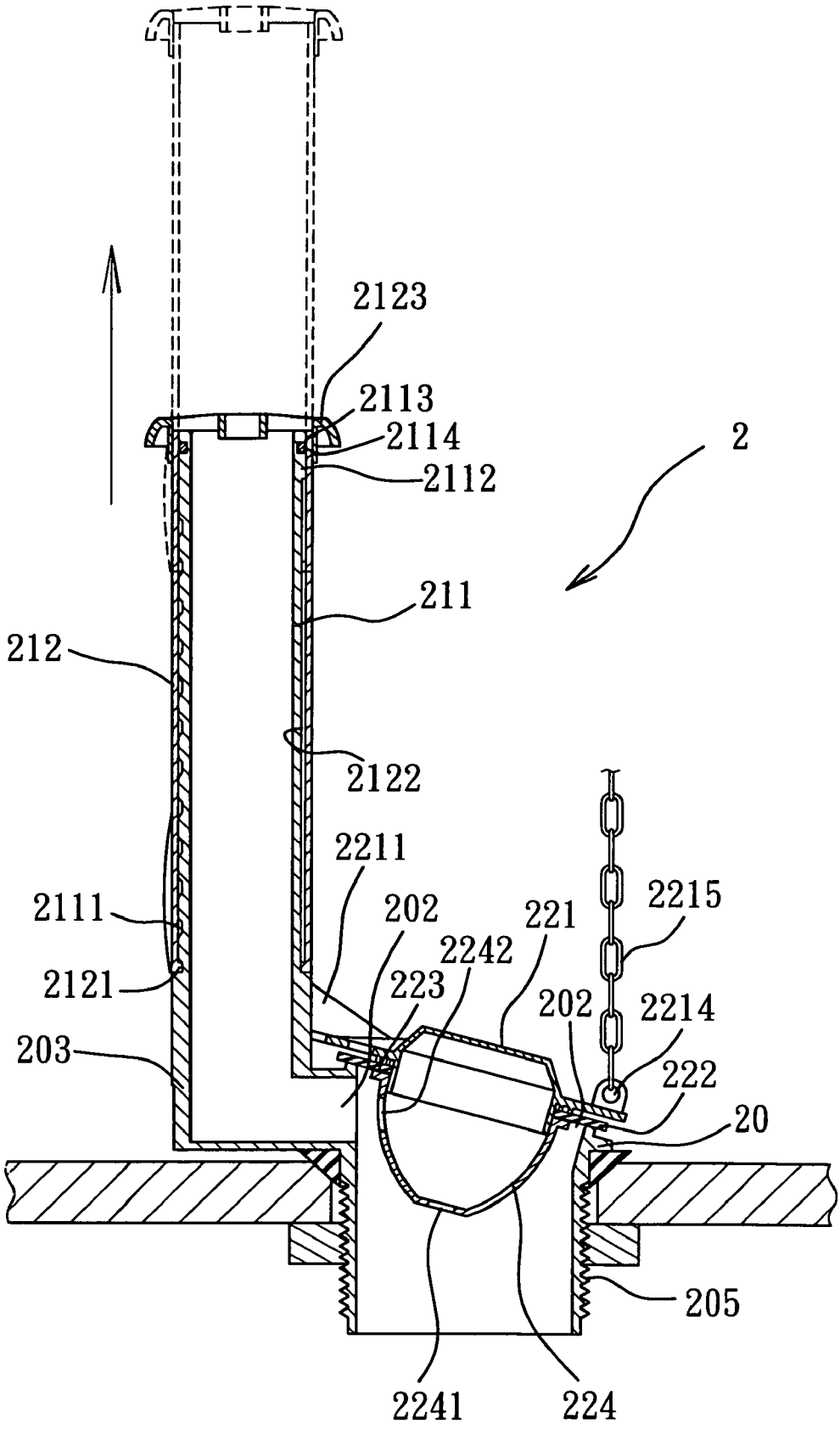
FIG. 4 is a schematic view of the invention for adjusting the overflow tube.
Figure 5:
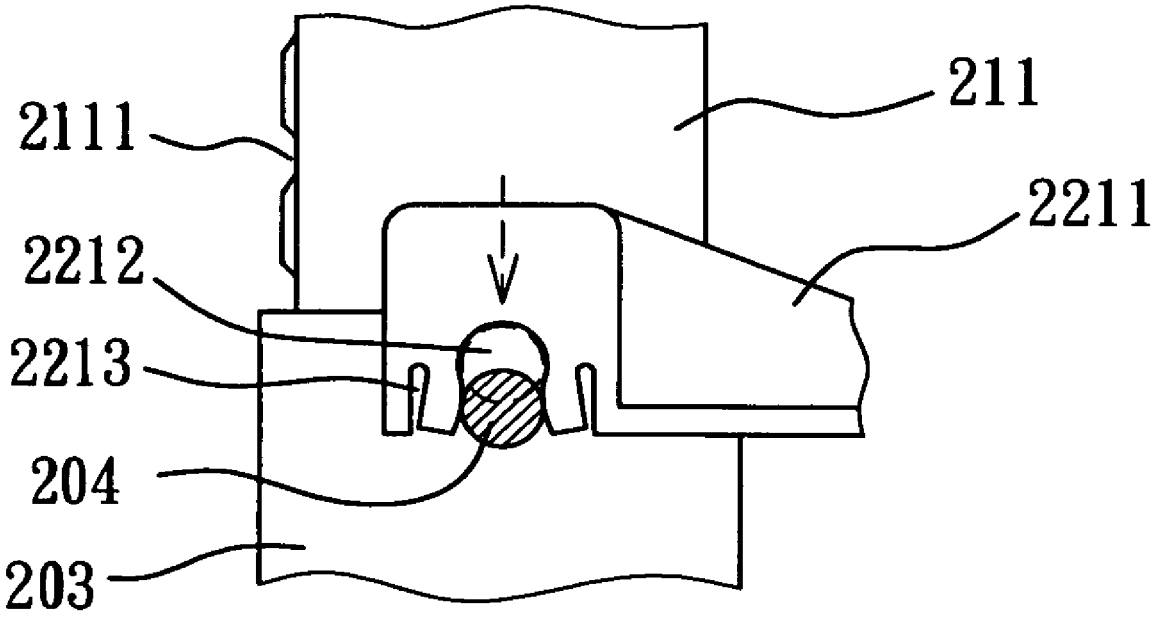
FIG. 5 is a schematic view of the invention for coupling operation.

By means of the elements and construction set forth above, the outer tube 212 is coupled on the inner tube 211 from outside with the hook 2121 latching on the gear rack 2111. The outer tube 212 may be moved up and down for a selected distance to adjust the length of the overflow tube 21 to suit the water level of the tank (referring to FIG. 4). Moreover, The slots 2213 on two sides of the anchor notch 2212 provide the anchor notch 2212 with a desired elasticity so that it may be expanded towards two sides when coupling with the struts 204 without causing damages (referring to FIG. 5).

Figure 6:
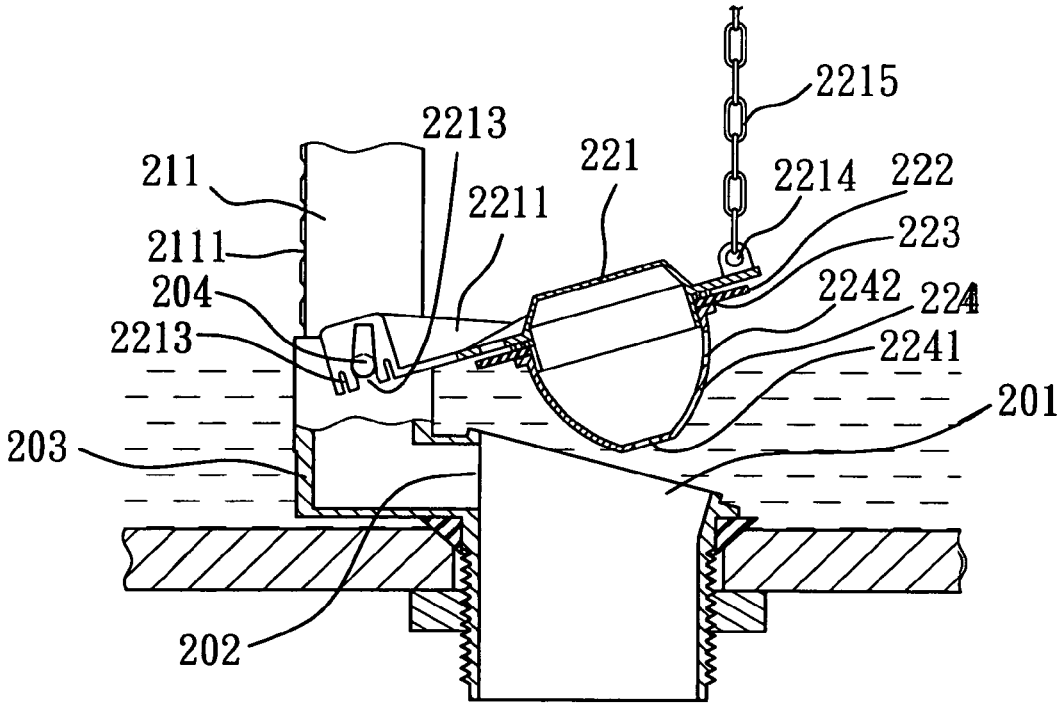
FIG. 6 is a schematic view of the invention showing plug operation-1.
Figure 7:
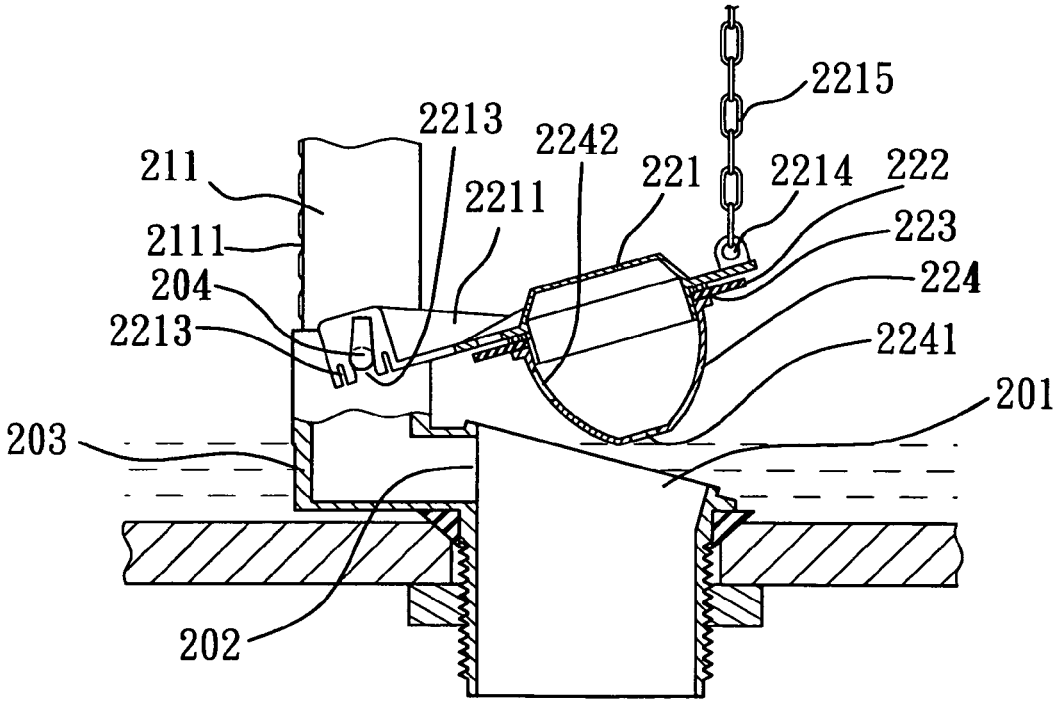
FIG. 7 is a schematic view of the invention showing plug operation-2.

Referring to FIGS. 6 and 7, the plug dome 224 of the plug 22 also provides water discharge adjustment function. When the air vent 2242 of the plug dome 224 is located on a upper side (referring to FIG. 6), and the cap 221 opens, the water level drops and water pressure decrease gradually, the water in the tank continuously flows through the water inlet 2241 into the plug dome 224. The plug dome 224 becomes heavier and result in the plug 22 sinking to close the valve opening 201. Due to the water in the tank is not yet fully depleted, such a mechanism can save water consumption. On the other hand, when the plug 224 is turned and the air vent 2242 is located on a lower position (referring to FIG. 7), and the water in the tank starts discharging, due to the inverse pressure effect caused by pressure difference, water in the tank is difficult to enter the plug dome 224, thus the plug 22 closes slowly, and the water in the tank can be fully discharged. Therefore by turning the plug dome 224 to alter the location of the air vent 2242, the closing speed of the plug 22 may be controlled to adjust the amount of the storing water.

In summary, the invention provides an overflow tube that has an adjustable length to suit different water levels and a plug which is easier to couple and replace. It offers a significant improvement over the conventional techniques.

I claim:

1. A toilet tank valve seat structure, comprising:

a body having a hollow valve opening in the center and a water discharge toilet outlet on one side of the valve opening housed by a jutting dock, the jutting dock having two struts located on two sides;

an overflow tube including an inner tube which has one end mounted onto the jutting dock and an outer tube coupling on the inner tube from outside; and a plug including a cap, a seal pad, a washer and a plug dome to cover the valve opening and being movable about the struts which function as a fulcrum, wherein the inner tube is hollow and has a gear rack located on one side and a bulged rim on a top end which has an annular groove to couple with a seal ring.

2. The toilet tank valve seat structure of claim 1, wherein the outer tube is hollow to couple on the inner tube from outside and has a hook and a bulged rim on an inner side of a lower end, the hook being engageable with the gear rack.

3. The toilet tank valve seat structure of claim 1, wherein the cap is a circular tray larger than the valve opening and has two arms extended from one side that have a distal end, the distal end having an anchor notch to couple with the struts of the body and two slots on two sides of the anchor notch.

4. The toilet tank valve seat structure of claim 1, wherein the seal pad is a pliable blade and has an outer diameter larger than the valve opening and a round opening in the center to couple with a lower side of the cap.

5. The toilet tank valve seat structure of claim 1, wherein the waster is a hard blade and has a round opening and is sandwiched between the seal pad and the plug dome.

6. A toilet tank valve seat structure, comprising:

a body having a hollow valve opening in the center and a water discharge toilet outlet on one side of the valve opening housed by a jutting dock, the jutting dock having two struts located on two sides;

an overflow tube including an inner tube which has one end mounted onto the jutting dock and an outer tube coupling on the inner tube from outside; and a plug including a cap, a seal pad, a washer and a plug dome to cover the valve opening and being movable about the struts which function as a fulcrum, wherein the outer tube is hollow to couple on the inner tube from outside and has a hook and a bulged rim on an inner side of a lower end, the hook being engageable with the gear rack.

7. A toilet tank valve seat structure, comprising:

a body having a hollow valve opening in the center and a water discharge toilet outlet on one side of the valve opening housed by a jutting dock, the jutting dock having two struts located on two sides;

an overflow tube including an inner tube which has one end mounted onto the jutting dock and an outer tube coupling on the inner tube from outside; and a plug including a cap, a seal pad, a washer and a plug dome to cover the valve opening and being movable about the struts which function as a fulcrum, wherein the cap is a circular tray larger than the valve opening and has two arms extended from one side that have a distal end, the distal end having an anchor notch to couple with the struts of the body and two slots on two sides of the anchor notch.

* * * * *